US009688292B2

(12) United States Patent
Nishimura et al.

(10) Patent No.: US 9,688,292 B2
(45) Date of Patent: Jun. 27, 2017

(54) RAILCAR BOGIE

(71) Applicant: KAWASAKI JUKOGYO KABUSHIKI KAISHA, Kobe-shi, Hyogo (JP)

(72) Inventors: Takehiro Nishimura, Kobe (JP); Shunichi Nakao, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 17 days.

(21) Appl. No.: 14/787,056

(22) PCT Filed: Apr. 14, 2014

(86) PCT No.: PCT/JP2014/002103
§ 371 (c)(1),
(2) Date: Oct. 26, 2015

(87) PCT Pub. No.: WO2014/174787
PCT Pub. Date: Oct. 30, 2014

(65) Prior Publication Data

US 2016/0082985 A1 Mar. 24, 2016

(30) Foreign Application Priority Data

Apr. 24, 2013 (JP) ..... 2013-091156

(51) Int. Cl.
*B61F 5/00* (2006.01)
*B61F 5/20* (2006.01)
(Continued)

(52) U.S. Cl.
CPC ..... *B61F 5/20* (2013.01); *B61F 3/04* (2013.01); *B61F 5/04* (2013.01); *B61F 5/14* (2013.01); *B61F 5/302* (2013.01); *B61F 5/52* (2013.01)

(58) Field of Classification Search
CPC ..... B61F 3/04; B61F 5/00; B61F 5/04; B61F 5/14; B61F 5/302; B61F 5/52; B61F 5/20;
(Continued)

(56) References Cited

U.S. PATENT DOCUMENTS 4,082,043 A * 4/1978 Hammonds ..... B61F 5/14 105/182.1
6,305,297 B1 * 10/2001 Landrot ..... B61F 5/302 105/157.1
(Continued)

FOREIGN PATENT DOCUMENTS

GB 2 325 909 A 12/1998
JP 31-8411 B1 9/1956
(Continued)

OTHER PUBLICATIONS

Jul. 8, 2014 International Search Report issued in International Patent Application No. PCT/JP2014/002103.
(Continued)

*Primary Examiner* — Jason C Smith
(74) *Attorney, Agent, or Firm* — Oliff PLC

(57) ABSTRACT

A railcar bogie includes: a bogie frame including a cross beam and plate springs, the plate springs supporting both respective car width direction end portions of the cross beam and extending in a car longitudinal direction; axles extending in a car width direction; bearings provided at both respective car width direction sides of each of the axles; axle boxes accommodating the respective bearings and supporting the plate springs from below; and rubbing plates provided on an upper surface of the bogie frame to slidingly contact respective rubbed plates provided on a lower surface of a bolster. In a plan view, each of the rubbing plates is arranged within a region where the cross beam and the plate spring intersect with each other and is arranged on a center
(Continued)

line of the plate spring, the center line extending in the car longitudinal direction.

8 Claims, 8 Drawing Sheets

(51) Int. Cl.

| | |
|---|---|
| ***B61F 5/14*** | (2006.01) |
| ***B61F 5/52*** | (2006.01) |
| ***B61F 3/04*** | (2006.01) |
| ***B61F 5/30*** | (2006.01) |
| ***B61F 5/04*** | (2006.01) |

(58) Field of Classification Search
CPC .... B61F 5/22; B61F 5/24; B61F 5/142; B61F 5/144; B61F 5/146; B61F 5/148; B61F 5/30
See application file for complete search history.

(56) References Cited

U.S. PATENT DOCUMENTS

| | | | | |
|---|---|---|---|---|
| 6,338,300 | B1 * | 1/2002 | Landrot | B61F 5/305 105/182.1 |
| 8,656,839 | B2 * | 2/2014 | Nishimura | B61C 9/50 105/182.1 |
| 9,352,757 | B2 * | 5/2016 | Nishimura | B61F 3/02 |
| 9,358,989 | B2 * | 6/2016 | Nishimura | B61F 5/52 |
| 9,376,127 | B2 * | 6/2016 | Nishimura | B61F 5/32 |
| 9,421,987 | B2 * | 8/2016 | Becher | B61F 5/52 |
| 9,493,174 | B2 * | 11/2016 | Nishimura | B61F 5/52 |
| 9,527,516 | B2 * | 12/2016 | Nishimura | B61F 5/52 |
| 2016/0082985 | A1 * | 3/2016 | Nishimura | B61F 3/04 105/197.05 |

FOREIGN PATENT DOCUMENTS

| | | | |
|---|---|---|---|
| JP | 2007-216876 | A | 8/2007 |
| JP | 2010-070000 | A | 4/2010 |
| JP | 2012-116279 | A | 6/2012 |
| WO | 2012/137257 | A1 | 10/2012 |

OTHER PUBLICATIONS

Oct. 27, 2015 International Preliminary Report on Patentability issued in International Patent Application No. PCT/JP2014/002103.
Apr. 5, 2016 Office Action issued in Chinese Patent Application No. 201480002001.8.
Jun. 7, 2016 Third Party Submission in Japanese Patent Application No. 2013-91156.
"Dynamics of Railcars (Latest Technology for Bogies)." Edited by the Japan Society of Mechanical Engineering, Published by Denkisya Kenkyukai Co., Ltd., First Edition, published on Dec. 25, 1994.
Shimokawa et al., "Development of New Concept Steering Bogie." Technical Report of Nippon Steel & Sumitomo Metal Corporation, vol. 395, pp. 41-44, Apr. 2013 Issue, published on Mar. 28, 2013.
Wako et al., "Development of FRP Bogie." Report of Railway Technical Research Institute, vol. 6, #10, pp. 19-25, published on Mar. 28, 2013.

* cited by examiner

RAILCAR BOGIE

TECHNICAL FIELD

The present invention relates to a bogie supporting a carbody of a railcar.

BACKGROUND ART

A bogie for supporting a carbody of a railcar and allowing the railcar to travel along a rail is provided under a floor of the carbody. PTL 1 discloses a bogie including: a bolster attached to a carbody via bolster anchors; and a bogie frame supporting the bolster from below so as to be turnable relative to the bolster. To suppress a meander motion, the bogie frame is provided with a side bearing which contacts a slide portion of a lower surface of the bolster to apply turning resistance to the bogie frame. To reduce a slide stroke length between the side bearing and the slide portion of the bolster, the side bearing is generally arranged close to a center plate that is a turning center.

PTL 2 discloses a bogie including a turning resistance adjuster capable of adjusting the turning resistance depending on travel conditions. The turning resistance adjuster includes: a damper provided at a bogie frame and capable of contacting an outer peripheral surface of a slide center plate of a carbody from a lateral direction; and an actuator configured to cause the damper to contact or separate from the slide center plate depending on the travel conditions. As above, according to PTL 2, a region in the vicinity of the turning center of the bogie frame is occupied by the turning resistance adjuster. Therefore, PTL 2 discloses an embodiment in which side bearings are arranged at both respective left and right ends of the bogie frame to be separated from the turning center.

CITATION LIST

Patent Literature

PTL 1: Japanese Laid-Open Patent Application Publication No. 2010-70000

PTL 2: Japanese Laid-Open Patent Application Publication No. 2007-216876

SUMMARY OF INVENTION

Technical Problem

However, in the bogie of PTL 2, the side bearing is biasedly arranged at a car width direction outer side of an upper surface of a side sill of the bogie frame, the side sill extending in a car longitudinal direction. Therefore, a load biased toward the car width direction outer side is applied to the side sill by a carbody load applied to the side bearing. With this, the requirement of the strength of the bogie frame increases. On this account, the bogie frame needs to be reinforced or the like, and therefore, the bogie frame becomes complex and heavy. In a case where the side bearing is located on an upper surface of a cross beam of the bogie frame, a bending load is applied to the cross beam by the weight of the carbody. This also becomes a cause of the increase in the requirement of the strength of the bogie frame.

An object of the present invention is to reduce a biased load and bending load applied to a bogie frame by the weight of a carbody, simplify the bogie frame, and reduce the weight of the bogie frame.

Solution to Problem

A railcar bogie according to the present invention is a bogie supporting a carbody of a railcar, the bogie including: a bogie frame including a cross beam and side members and being rotatable relative to the carbody in a yawing direction, the cross beam extending in a car width direction, the side members supporting both respective car width direction end portions of the cross beam and extending in a car longitudinal direction; axles extending in the car width direction; bearings provided at both respective car width direction sides of each of the axles and rotatably supporting the axles; axle boxes accommodating the respective bearings and supporting the side members from below; and rubbing plates provided on an upper surface of the bogie frame to slidingly contact respective rubbed plates provided on a lower surface of a member attached to the carbody, in a plan view, each of the rubbing plates being arranged within a region where the cross beam and the side member intersect with each other and being arranged on a center line of the side member, the center line extending in the car longitudinal direction.

According to the above configuration, in a plan view, the rubbing plate is arranged on the center line of the side member so as to be located within the region where the cross beam and the side member intersect with each other, the center line extending in the car longitudinal direction. Therefore, the carbody load applied through the rubbed plate to the rubbing plate is applied to the side member from right above, the side member being supported by the axle boxes. On this account, a load biased in the car width direction is prevented from being applied to the side member, and a bending load by the weight of the carbody is prevented from being applied to the cross beam. As a result, the requirement of the strength of the bogie frame can be relaxed, and the bogie frame can be simplified and reduced in weight.

Advantageous Effects of Invention

As is clear from the above explanations, according to the present invention, the load biased in the car width direction is prevented from being applied to the side member, and the bending load by the weight of the carbody is prevented from being applied to the cross beam. Therefore, the requirement of the strength of the bogie frame can be relaxed, and the bogie frame can be simplified and reduced in weight.

DESCRIPTION OF EMBODIMENTS

Figure 1:
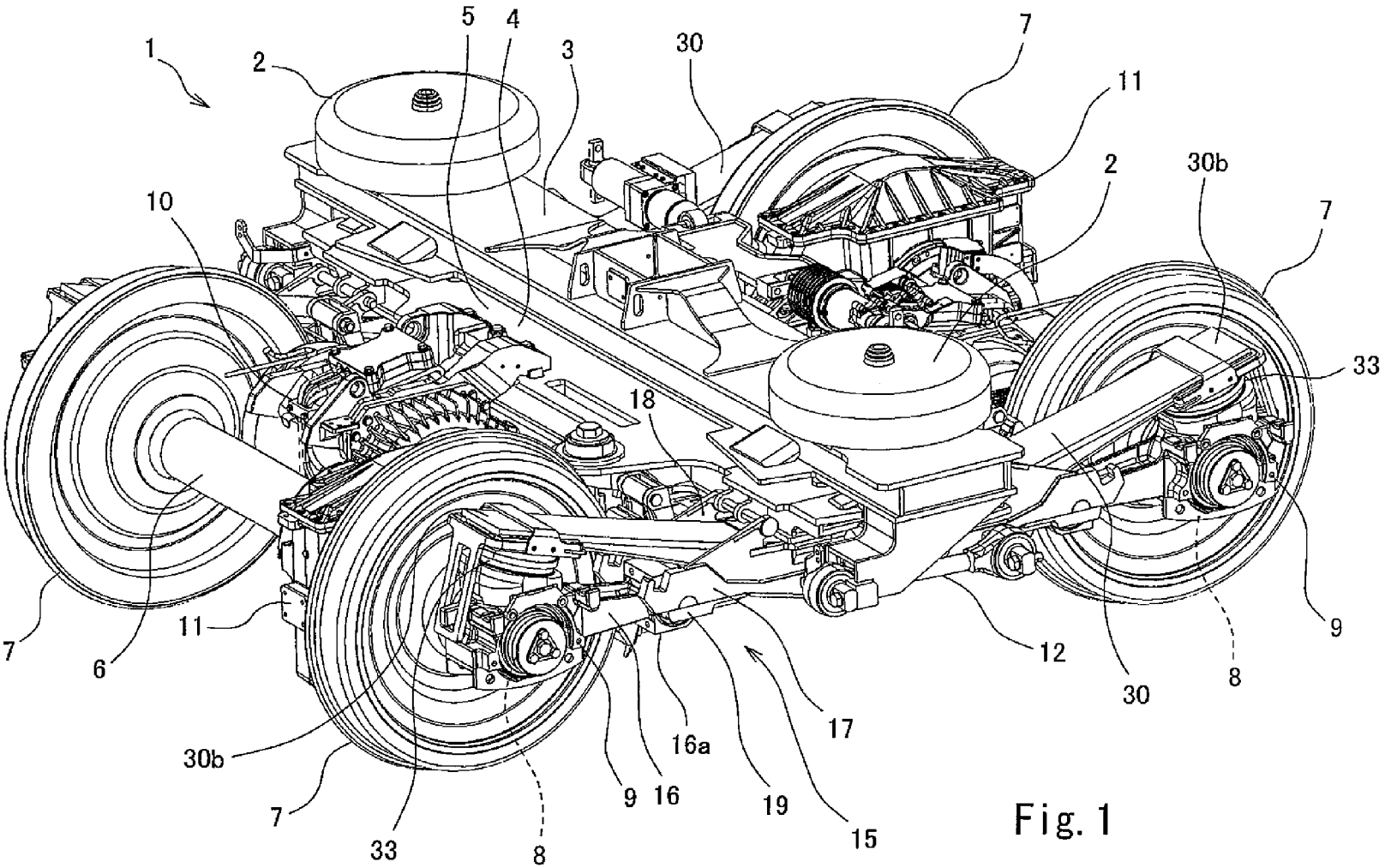
FIG. 1 is a perspective view showing a railcar bogie according to a first embodiment.

Hereinafter, embodiments will be explained in reference to the drawings. In the following explanations, each of a direction in which a railcar travels and a length direction in which a carbody extends is defined as a car longitudinal direction, and a lateral direction perpendicular to the car longitudinal direction is defined as a car width direction (in the embodiments, the car longitudinal direction is also referred to as a forward/rearward direction, and the car width direction is also referred to as a leftward/rightward direction). In the drawings, the same reference signs are used for the same components.

First Embodiment

Figure 2:
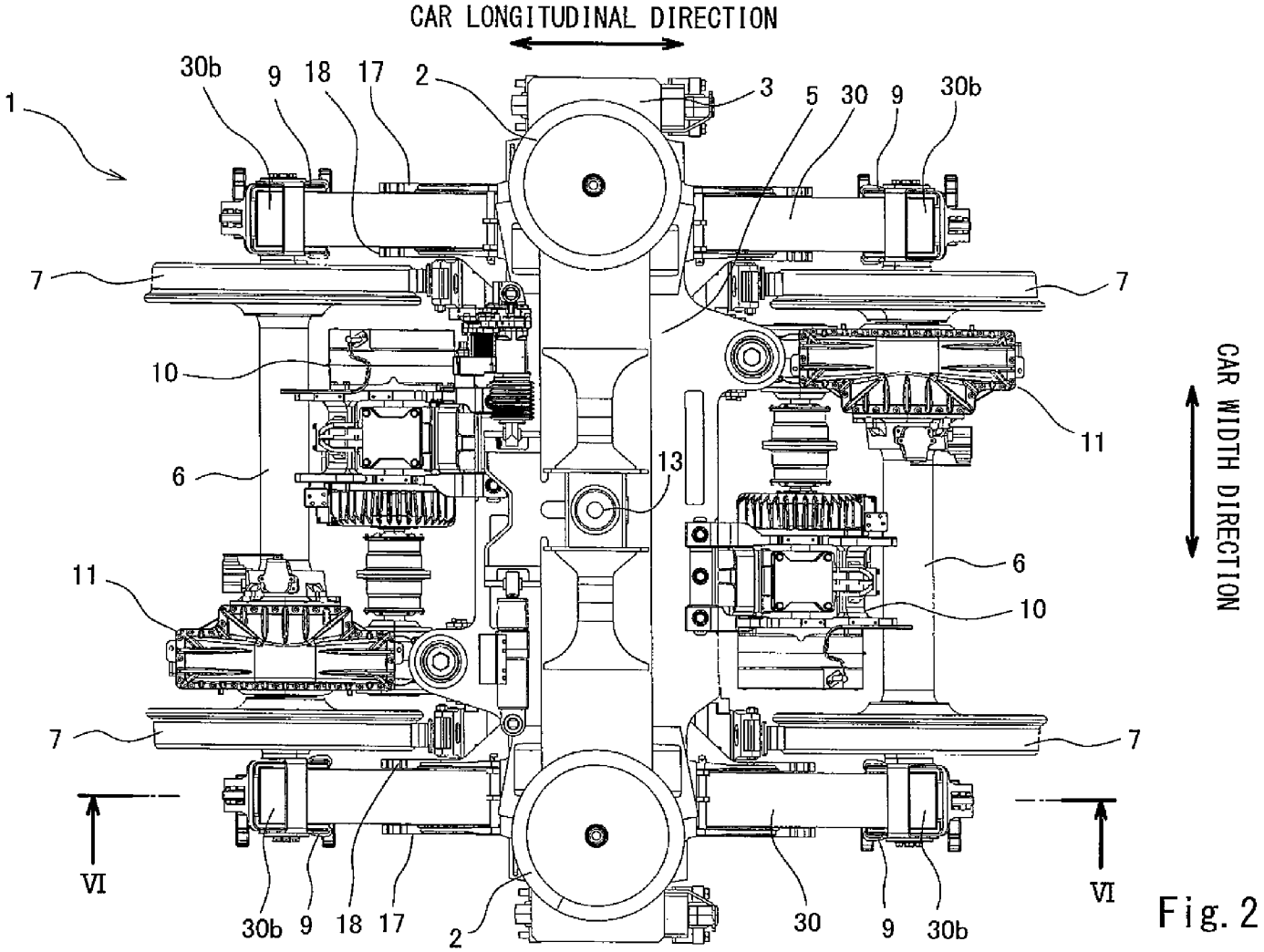
FIG. 2 is a plan view of the bogie shown in FIG. 1.

FIG. 1 is a perspective view showing a railcar bogie 1 according to the first embodiment. FIG. 2 is a plan view of the bogie 1 shown in FIG. 1. As shown in FIGS. 1 and 2, the railcar bogie 1 includes a bolster 3 and a bogie frame 4. The bolster 3 is attached to a carbody (not shown) via air springs 2 serving as secondary suspensions and supports the carbody. The bogie frame 4 supports the bolster 3 so as to be rotatable relative to the bolster 3 in a yawing direction. The bolster 3 is located at a car longitudinal direction middle portion of the bogie 1 and extends in the car width direction. The air springs 2 are arranged at respective upper surfaces of left and right end portions of the bolster 3. The bogie frame 4 includes a cross beam 5 and plate springs 30 (side members). The cross beam 5 extends in the car width direction that is the leftward/rightward direction and supports the carbody. The plate springs 30 (side members) support both respective car width direction end portions of the cross beam 5 from below and extend in the car longitudinal direction.

The cross beam 5 is turnably connected to the bolster 3 via a turn guide mechanism 13. The bolster 3 is connected to the carbody (not shown) via the air springs 2 and bolster anchors 12. In the present embodiment, the turn guide mechanism 13 includes a concave portion 13*a* and a convex portion 13*b*. The concave portion 13*a* is formed on an upper surface of a center portion of the cross beam 5, and the convex portion 13*b* projects from a lower surface 3*b* of a center portion of the bolster 3 and is fitted to the concave portion 13*a*. Front and rear axles 6 extending along the car width direction are arranged in front of and behind the cross beam 5, respectively. Wheels 7 are fixed to both respective car width direction sides of each axle 6. Bearings 8 are provided at both respective car width direction end portions of each axle 6 so as to be located outside the wheels 7 in the car width direction. The bearings 8 rotatably support the axles 6. The bearings 8 are accommodated in respective axle boxes 9. Electric motors 10 are attached to the cross beam 5, and reducers 11 which transmit power to the respective axles 6 are connected to respective output shafts of the electric motors 10.

Each of the plate springs 30 extending in the car longitudinal direction is provided between the cross beam 5 and the axle box 9. Longitudinal direction middle portions 30*a* (see FIG. 6) of the plate springs 30 support both respective car width direction end portions of the cross beam 5 from below. Both longitudinal direction end portions 30*b* of each of the plate springs 30 are supported by the respective axle boxes 9 from below. To be specific, each of the plate springs 30 serves as both a primary suspension and a conventional side sill. The plate springs 30 are made of, for example, fiber-reinforced resin, and the middle portions 30*a* (see FIG. 6) of the plate springs 30 are arranged under the cross beam 5. Pressing members 31 (see FIG. 6) are provided under the respective car width direction end portions of the cross beam 5. Each of the pressing members 31 is provided between a pair of receiving seats 17 and 18 and has a lower surface 31*a* formed in a circular-arc shape in a side view. The pressing members 31 are disposed on the respective middle portions 30*a* of the plate springs 30 from above. To be specific, the pressing members 31 press respective upper surfaces of the plate springs 30 downward by a carbody load, transmitted from the cross beam 5, so as not to fix the plate springs 30 in an upper/lower direction. The pressing member 31 is formed by a stiff member (for example, metal or fiber-reinforced resin).

Spring seats 33 are attached to respective upper portions of the axle boxes 9. The end portions 30*b* of the plate springs 30 are disposed on the respective spring seats 33 from above. To be specific, the end portions 30*b* of each of the plate springs 30 are supported by the respective axle boxes 9 via the respective spring seats 33. The spring seats 33 support both respective end portions 30*b* of each of the plate springs 30 such that upper surfaces of the end portions 30*b* of each of the plate springs 30 are inclined in a direction toward the middle portion 30*a*. The middle portion 30*a* of the plate spring is pressed by the lower surface 31*a* of the pressing member 31 (see FIG. 6) to have a circular-arc shape. To be specific, the middle portion 30*a* is located under the end portions 30*b*, and the entire plate spring 30 has a bow shape that is convex downward in a side view.

The axle boxes 9 are coupled to the car width direction end portions of the cross beam 5 by coupling devices 15 constituting axle box suspensions. Each of the coupling devices 15 includes axle beams 16, a pair of receiving seats 17 and 18, and coupling portions 19. Each of the axle beams 16 projects integrally from the axle box 9 toward the cross beam 5. The receiving seats 17 and 18 project from the cross beam 5 toward the axle beams 16. Each of the coupling portions 19 includes a rubber bushing or the like (not shown), and elastically couples a tip end portion 16*a* of the axle beam 16 to the receiving seats 17 and 18. To be specific, the coupling device 15 of the present embodiment is an axle beam type device.

Figure 3:
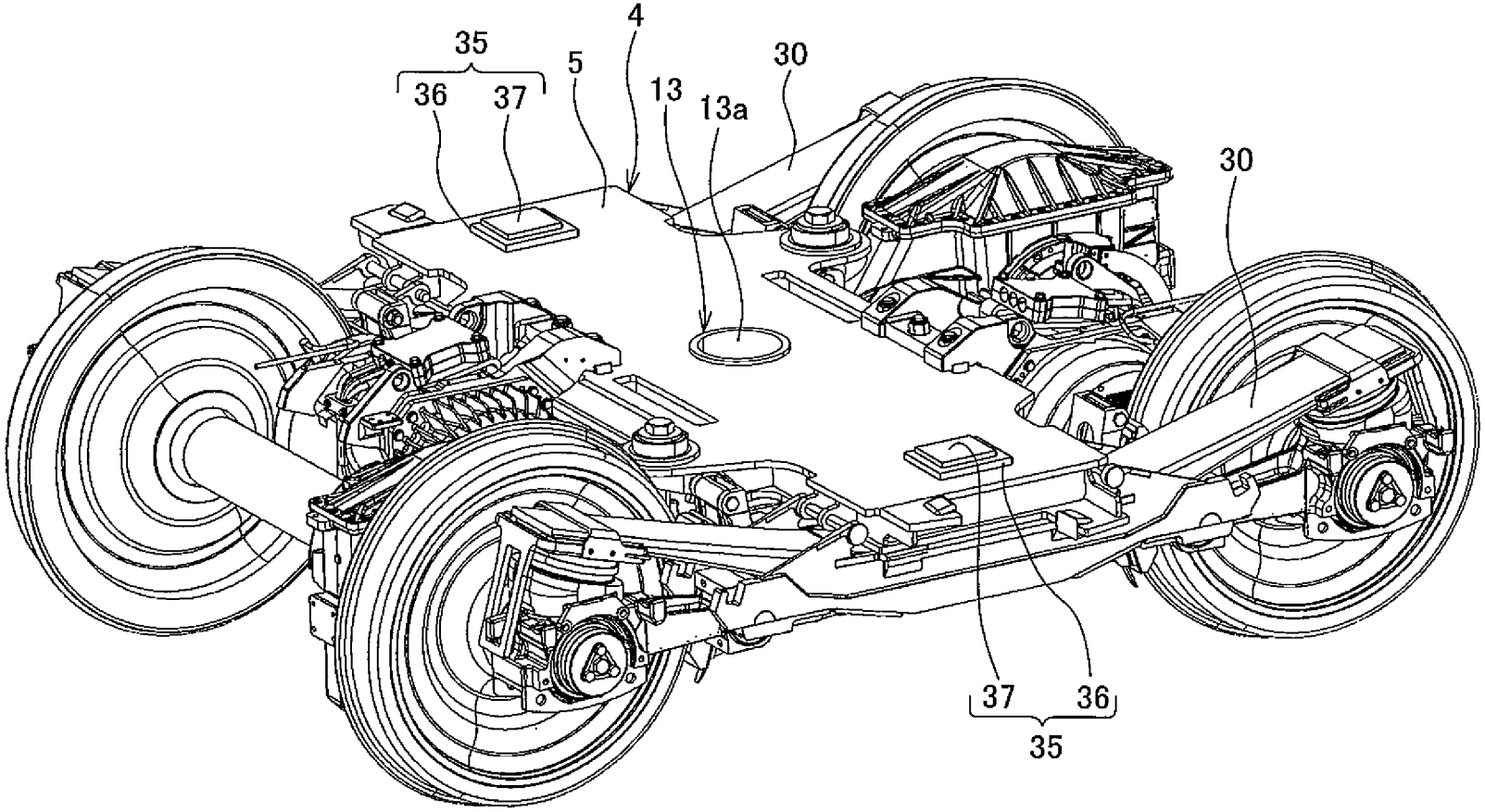
FIG. 3 is a perspective view showing a state where a bolster is detached from the bogie shown in FIG. 1.
Figure 4:
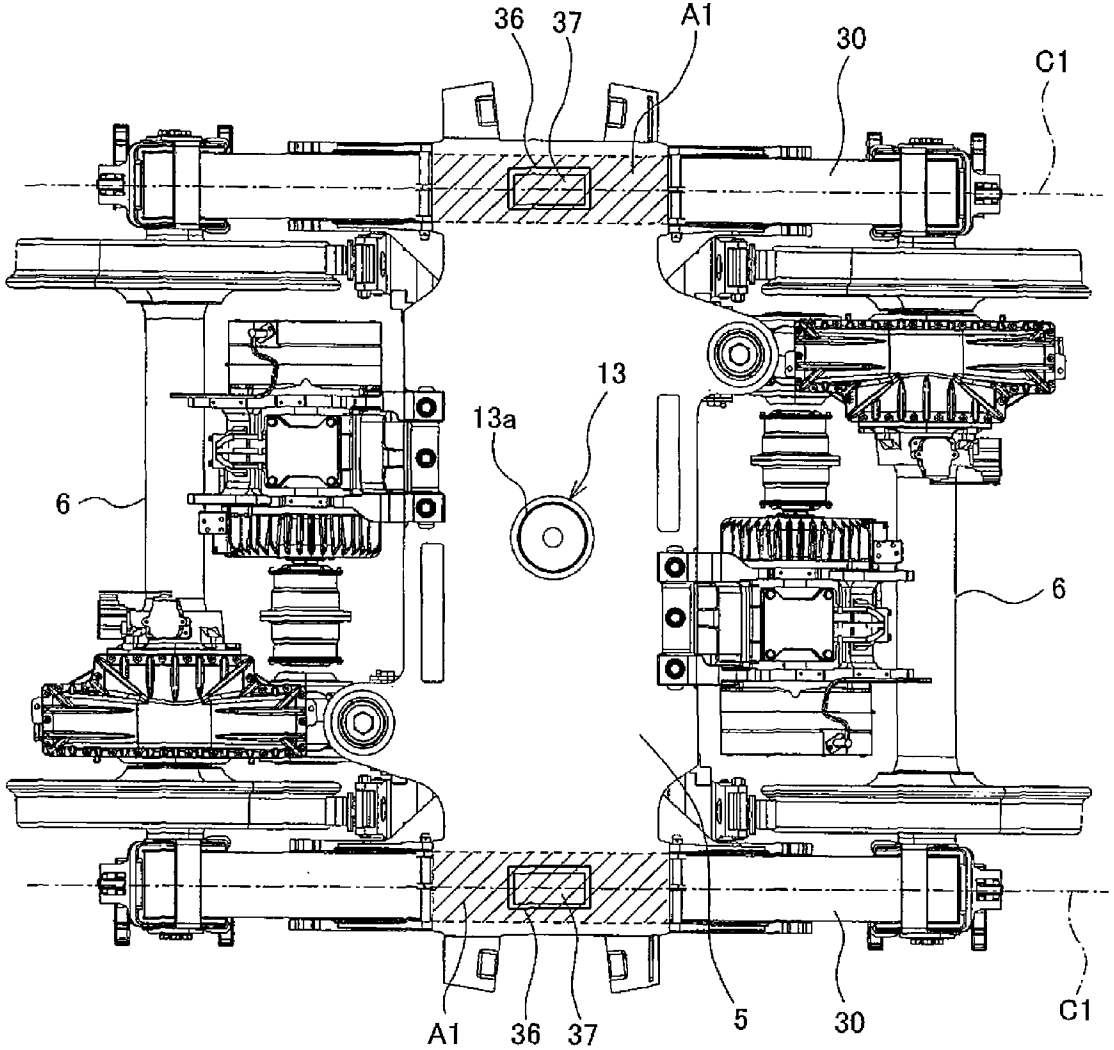
FIG. 4 is a plan view of the bogie shown in FIG. 3.

FIG. 3 is a perspective view showing a state where the bolster 3 is detached from the bogie 1 shown in FIG. 1. FIG. 4 is a plan view of the bogie 1 shown in FIG. 3. As shown in FIGS. 3 and 4, rubbing plate units 35 are provided on respective upper surfaces of both car width direction end portions of the cross beam 5 of the bogie frame 4. Each of the rubbing plate units 35 includes: a receiving member 36 fixed to an upper surface of the cross beam 5; and a rubbing plate 37 accommodated in a concave portion formed on an upper surface of the receiving member 36. The rubbing plate 37 projects upward from the receiving member 36. The rubbing plate 37 is made of a material having a desired friction coefficient.

In a plan view, the rubbing plate 37 is arranged so as not to protrude from a region A1 where the cross beam 5 and the plate spring 30 intersect with each other. To be specific, in a plan view, the rubbing plate 37 is arranged within the region A1 (a hatching portion in FIG. 4). In addition, in a plan view, the rubbing plate 37 is arranged on a center line C1 of the plate spring 30, the center line C1 extending in the car longitudinal direction. In the present embodiment, the rubbing plate 37 is arranged at a center of the region A1, and a center of the rubbing plate 37 coincides with the center line C1 of the plate spring 30. In a plan view, the rubbing plate 37 has a shape symmetric to the center line C1. In the present embodiment, the rubbing plate 37 has a rectangular shape. The other devices (for example, a movable device such as a turning resistance adjuster) are not arranged in a region on the upper surface of the cross beam 5, the region being located between the concave portion 13*a* of the turn guide mechanism 13 and the rubbing plate unit 35.

Figure 5:
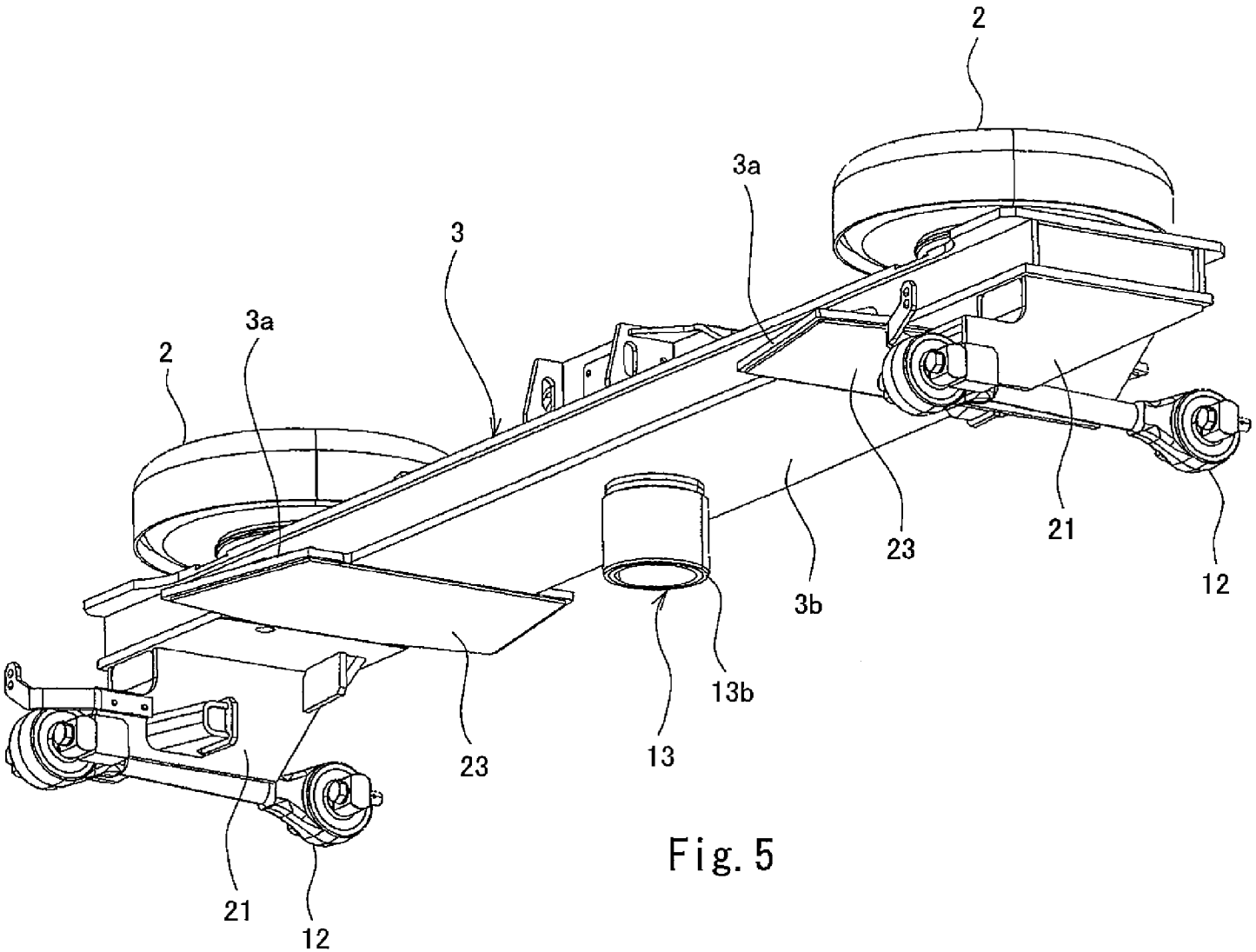
FIG. 5 is a perspective view of the bolster of FIG. 1 when viewed from an obliquely lower side.

FIG. 5 is a perspective view of the bolster 3 of FIG. 1 when viewed from an obliquely lower side. As shown in FIG. 5, brackets 21 projecting downward are provided at both respective car width direction end portions of the bolster 3. The bolster anchors 12 which connect the carbody (not shown) with the bolster 3 are attached to the respective brackets 21. The bolster 3 includes projecting portions 3*a* each projecting toward both sides in the car longitudinal direction such that a lower surface of the bolster 3 partially expands in the car longitudinal direction at a position opposing the rubbing plate 37 (see FIG. 3). Rubbed plates 23 are attached to respective lower surfaces of both end portions of the bolster 3. The rubbed plates 23 slidingly contact the respective rubbing plates 37 (see FIG. 3). The rubbed plate 23 is provided at a position which opposes the rubbing plate 37 and is also provided at a position including a lower surface of the projecting portion 3*a*. The rubbed plate 23 is made of a material having a desired friction coefficient. In the present embodiment, the rubbed plates 23 and the rubbing plates 37 are arranged away from the turning center, so that a sliding trajectory of the rubbing plate 37 when the bogie frame 4 turns becomes long. Therefore, to prevent the sliding resistance from becoming high, a low friction material such as resin is used for the rubbed plates 23 and the rubbing plate 37. As the position of a rubbing plate having a certain friction coefficient gets away from the turning center, rotational resistance of the bogie increases, and higher lateral force acts on the wheels when the railcar travels along a curved line. Therefore, in consideration of such lateral force, the conventional rubbing plate having the high friction coefficient cannot be arranged at a position far away from the turning center. In the present embodiment, since the rubbing plate having a low friction coefficient is used, the rubbing plate can be arranged at a position away from the turning center. The other devices (for example, a movable device such as the turning resistance adjuster) are not arranged in a region on the lower surface of the bolster 3, the region being located between the convex portion 13*b* of the turn guide mechanism 13 and the rubbed plate 23.

Figure 6:
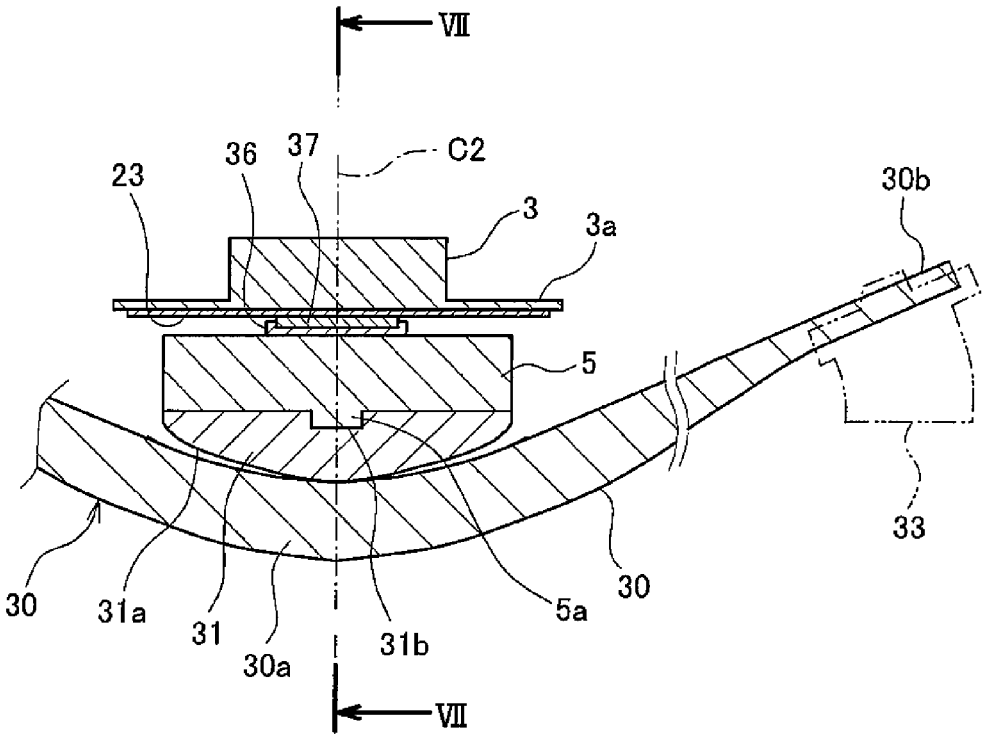
FIG. 6 is a cross-sectional view taken along line VI-VI of FIG. 2.
Figure 7:
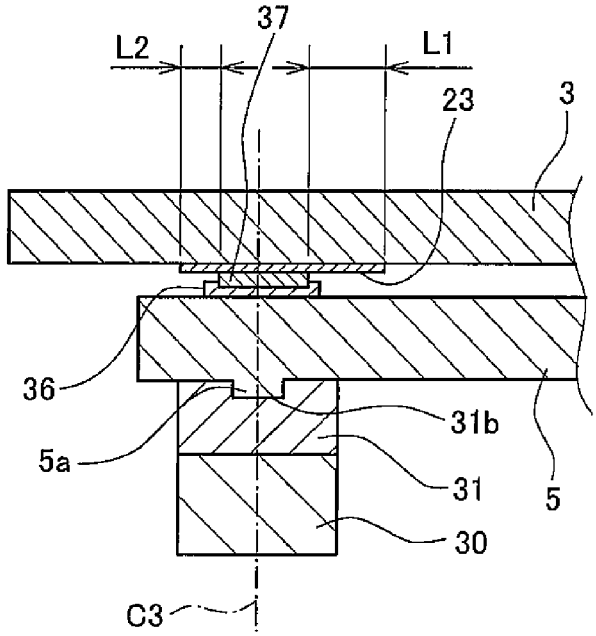
FIG. 7 is a cross-sectional view taken along line VII-VII of FIG. 6.

FIG. 6 shows a cross section taken along line VI-VI of FIG. 2. FIG. 7 is a cross-sectional view taken along line VII-VII of FIG. 6. As shown in FIGS. 6 and 7, the pressing members 31 are provided on respective lower surfaces of both car width direction end portions of the cross beam 5. Fitting portions 5*a* that are convex portions are formed on respective lower surfaces of both end portions of the cross beam 5. A fitted portion 31*b* which is fitted in the fitting portion 5*a* is formed on an upper surface of each of the pressing members 31. Each of the pressing members 31 is placed on the car longitudinal direction middle portion 30*a* of the plate springs 30 from above. The pressing member 31 does not support the lower surface of the plate spring 30, that is, the lower surface of the plate spring 30 is in an exposed state. In other words, the pressing member 31 is not fixed to the plate spring 30 in the upper/lower direction and presses the upper surface of the plate spring 30 downward so as to be separable from the upper surface of the plate spring 30. To be specific, the pressing of the pressing member 31 against the upper surface of the plate spring 30 is maintained by a carbody load transmitted through the air spring 2 (see FIG. 1), the bolster 3, the rubbed plate 23, the rubbing plate 37, the receiving member 36, and the cross beam 5.

When viewed from a lateral direction that is a direction (car width direction) perpendicular to the longitudinal direction of the plate spring 30, the lower surface 31*a* of the pressing member 31 has a circular-arc shape that is convex downward, the lower surface pressing the plate spring 30. Similarly, when viewed from the lateral direction that is the direction (car width direction) perpendicular to the longitudinal direction of the plate spring 30, an upper surface of the middle portion 30*a* has a circular-arc shape that is convex downward, the upper surface being pressed by the pressing member 31. In a state where the bogie 1 is not supporting the carbody (not shown), a curvature of the lower surface 31*a* of the pressing member 31 is larger than a curvature of the upper surface of the middle portion 30*a* of the plate spring 30. In a state where the bogie 1 is supporting the carbody (not shown), the plate spring 30 elastically deforms by the weight of the carbody such that the cross beam 5 moves downward. Thus, the curvature of the middle portion 30*a* of the plate spring 30 increases. However, when the car is empty, that is, when no passengers are in the carbody (not shown), the curvature of the lower surface 31*a* of the pressing member 31 is maintained to be larger than the curvature of the middle portion 30*a* of the plate spring 30. Therefore, a space is formed between the lower surface 31*a* of the pressing member 31 and the upper surface of the middle portion 30*a* of the plate spring 30 so as to be located at each of both longitudinal direction sides of a lowermost end of the pressing member 31.

As shown in FIG. 6, when viewed from the car width direction, the rubbing plate 37 is arranged so as to overlap a center line C2 extending through a center of the pressing member 31 in a vertical direction. In the present embodiment, when viewed from the car width direction, a center of the rubbing plate 37 is located on the center line C2 extending in the vertical direction through a lowermost point of the lower surface 31*a* of the pressing member 31. As shown in FIG. 7, when viewed from the car longitudinal direction, the rubbing plate 37 is arranged so as to overlap a center line C3 extending through the center of the pressing member 31 in the vertical direction. In the present embodiment, when viewed from the car width direction, the center of the rubbing plate 37 is located on the center line C2 extending in the vertical direction. A car width direction length L1 from a car width direction inside end of the rubbed plate 23 to the rubbing plate 37 is larger than a car width direction length L2 from a car width direction outside end of the rubbed plates 23 to the rubbing plate 37. This is because in a case where the left and right rubbing plates 37 are arranged away from the cross beam 5 in the car width direction, and the bogie frame 4 rotates relative to the bolster 3 in the yawing direction, the rubbing plate 37 may move relative to the rubbed plate 23 toward a car width direction inner side when viewed from the car longitudinal direction.

According to the configuration explained as above, when the bogie frame 4 rotates relative to the bolster 3 in the yawing direction, the rubbing plates 37 provided on the upper surface of the bogie frame 4 contact and slide on the respective rubbed plates 23 provided on the lower surface of the bolster 3, and therefore, appropriate rotation resistance is applied to the bogie frame 4. In a plan view, the rubbing plate 37 is arranged on the center line C1 of the plate spring 30 so as to be located within the region where the cross beam 5 and the plate spring 30 intersect with each other. Therefore, the carbody load applied through the rubbed plate 23 to the rubbing plate 37 is applied to the plate spring 30 from right above, the plate spring 30 being supported by the axle boxes 9. On this account, the load biased in the car width direction is prevented from being applied to the plate spring 30, and the bending load by the weight of the carbody is prevented from being applied to the cross beam 5.

In addition, in the present embodiment, the pressing member 31 and the plate spring 30 separably contact each other. Therefore, the biased load tends to be applied from the pressing member 31 to the plate spring 30. However, since the rubbing plate 37 is arranged as above, the plate spring 30 is prevented from being biasedly distorted. Thus, the plate spring 30 can be suitably protected. As a result, the requirement of the strength of the bogie frame 4 can be relaxed, and the bogie frame 4 can be simplified and reduced in weight.

Second Embodiment

Figure 8:
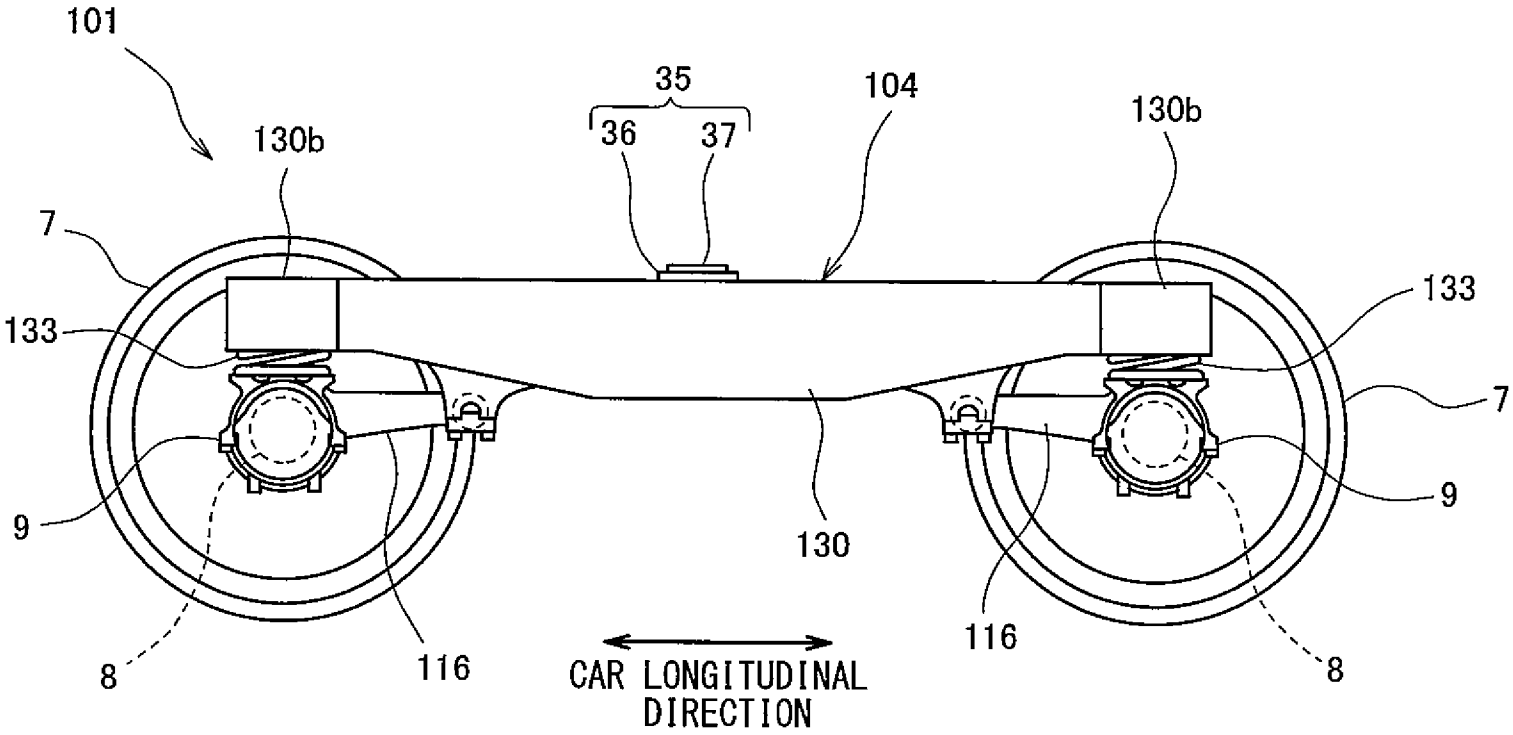
FIG. 8 is a side view showing the railcar bogie according to a second embodiment.
Figure 9:
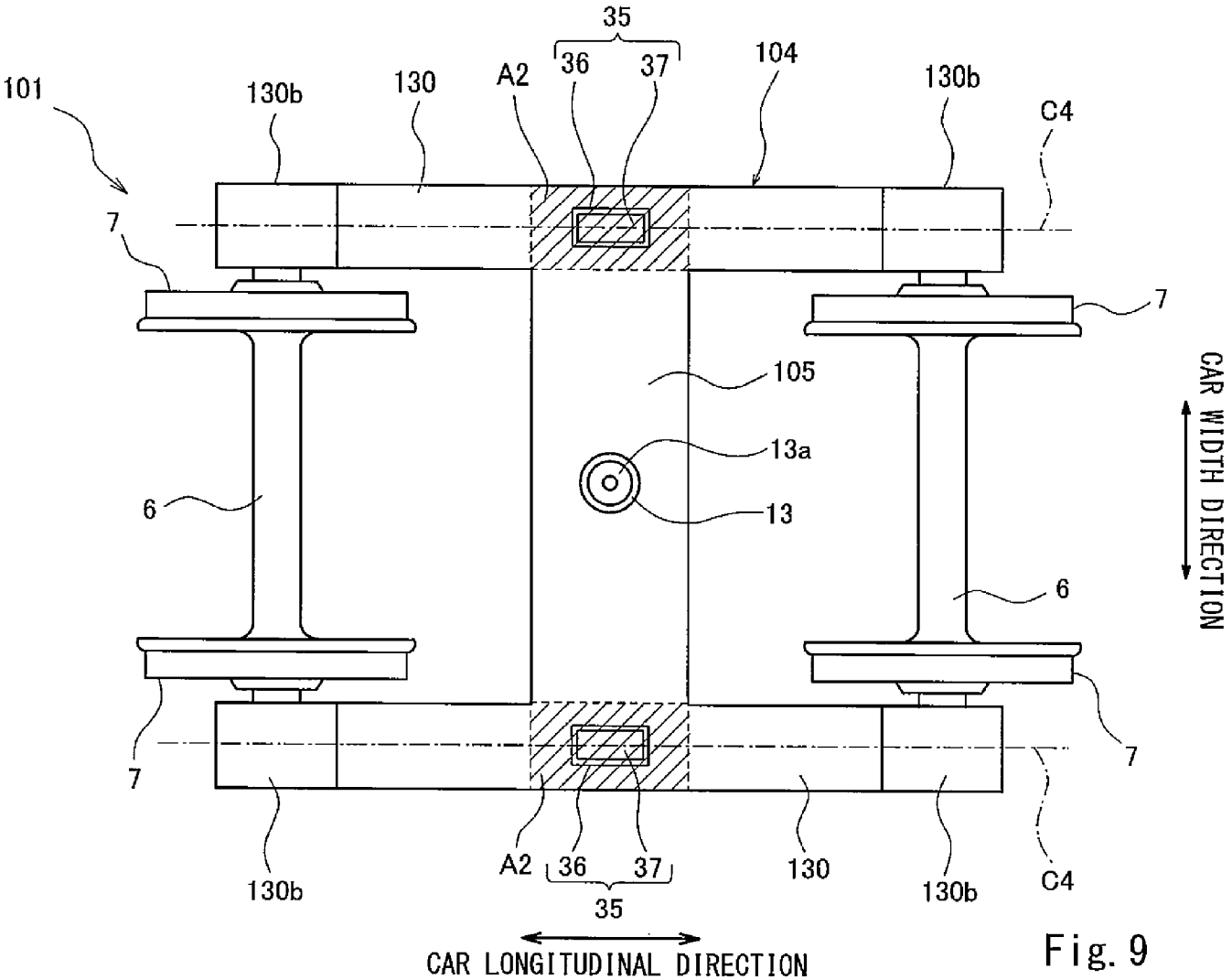
FIG. 9 is a plan view of the bogie shown in FIG. 8.

FIG. 8 is a side view showing a railcar bogie 101 according to the second embodiment. FIG. 9 is a plan view of the bogie 101 shown in FIG. 8. As shown in FIGS. 8 and 9, the bogie 101 of the second embodiment does not include the plate springs 30 as the side members. A bogie frame 104 of the second embodiment includes a pair of side sills 130 (side members) and a cross beam 105. The side sills 130 are located at both respective car width direction sides of the bogie frame 104 and extend in the car longitudinal direction. The cross beam 105 extends in the car width direction so as to couple car longitudinal direction middle portions, that is, forward/rearward direction middle portions of the side sills 130 to each other. The side sills 130 are fixed to the cross beam 105 by welding or the like, and the entire bogie frame 104 has an H shape in a plan view.

An axle box suspension 133 constituted by a coil spring (axle spring) is interposed between a car longitudinal direction end portion 130*b* of the side sill 130 and the axle box 9. An axle beam 116 extends integrally from the axle box 9 in the forward/rearward direction toward a center of the bogie. An end portion of the axle beam 116 is elastically coupled to the side sill 130 via a rubber bushing or the like. To be specific, the bogie 101 includes a so-called axle beam type axle box suspension. It should be noted that the axle box suspension may be an axle box suspension other than the axle beam type axle box suspension.

In a plan view, the rubbing plate unit 35 is provided on an upper surface of the bogie frame 104 so as to be located in a region A2 where the cross beam 105 and the side sill 130 intersect with each other. In a plan view, the rubbing plate 37 is arranged so as not to protrude from the region A2 where the cross beam 105 and the side sill 130 intersect with each other. To be specific, in a plan view, the rubbing plate 37 is arranged within the region A2. In addition, in a plan view, the rubbing plate 37 is arranged on a center line C4 of the side sill 130, the center line C4 extending in the car longitudinal direction. In the present embodiment, the rubbing plate 37 is arranged at a center of the region A2, and a center of the rubbing plate 37 coincides with the center line C4 of the side sill 130. The other devices (for example, a movable device such as the turning resistance adjuster) are not arranged in a region on an upper surface of the cross beam 105, the region being located between the concave portion 13*a* of the turn guide mechanism 13 and the rubbing plate unit 35. Although not shown, the bogie frame 104 supports the bolster 3 of the first embodiment from below. The other components are the same as those of the first embodiment. Therefore, the same reference signs are used for the same components, and detailed explanations thereof are omitted.

The present invention is not limited to the above embodiments, and modifications, additions, and eliminations may be made within the scope of the present invention. The above embodiments may be combined arbitrarily. For example, a part of components or methods in one embodiment may be applied to another embodiment. The above embodiments explained the bogie including the bolster. However, the present invention may be applied to a bolsterless bogie. In such a case, the rubbed plate may be directly attached to the carbody.

INDUSTRIAL APPLICABILITY

As above, the railcar bogie according to the present invention includes the above excellent effects. It is useful to widely apply the present invention to railcar bogies which can achieve the significance of the above effects.

REFERENCE SIGNS LIST

1, 101 bogie
3 bolster
4, 104 bogie frame
5, 105 cross beam
6 axle
8 bearing
9 axle box
23 rubbed plate
30 plate spring (side members)
37 rubbing plate
130 side sill (side members)

The invention claimed is:

1. A bogie supporting a carbody of a railcar, the bogie comprising:

a bogie frame including a cross beam extending in a car width direction and pressing members provided respectively under car width direction end portions of the cross beam, each of the pressing members having a lower surface formed in a downward convex shape in a side view, the bogie frame being rotatable relative to the carbody in a yawing direction;

axles extending in the car width direction;

bearings provided at both respective car width direction sides of each of the axles and rotatably supporting the axles;

plate springs supporting both respective car width direction end portions of the cross beam from below via respective pressing members and extending in a car longitudinal direction;

axle boxes accommodating the respective bearings and supporting both respective longitudinal direction end portions of each of the plate springs from below; and rubbing plates provided on an upper surface of the cross beam to slidingly contact respective rubbed plates provided on a lower surface of a member attached to the carbody, the pressing members not being fixed to the plate springs, a curvature of the lower surface of each of the pressing members being larger than a curvature of an upper surface of a middle portion of each of the plate springs in a state where the bogie is not supporting the carbody, in a plan view, each of the rubbing plates being arranged within a region where the cross beam and the plate spring intersect with each other and being arranged on a center line of the plate spring, the center line extending in the car longitudinal direction, in the side view, each of the rubbing plates being arranged on a center line extending through a center of the pressing member in a vertical direction.

2. The bogie according to claim 1, wherein a car width direction length from a car width direction inside end of the rubbed plate to the rubbing plate is larger than a car width direction length from a car width direction outside end to the rubbing plate.

3. The bogie according to claim 1, wherein the bolster including project portions each projects toward both sides in the car longitudinal direction such that a lower surface of the bolster partially expands in the car longitudinal direction at a position opposing the rubbing plate, the rubbed plate is attached to the lower surface of the bolster so as to be located at a position including a lower surface of the projecting portion.

4. A bogie supporting a carbody of a railcar, the bogie comprising:

a bogie frame including a cross beam being rotatable relative to the carbody in a yawing direction, the cross beam extending in a car width direction;

axles extending in the car width directions;

bearings provided at both respective car width direction sides of each of the axles and rotatably supporting the axles;

plate springs supporting both respective car width direction end portions of the cross beam from below via respective pressing members and extending in a car longitudinal direction, each of the pressing members having a lower surface formed in a downward convex shape in side view;

axle boxes accommodating the respective bearings and supporting both respective longitudinal direction end portions of each of the plate springs from below; and rubbing plates provided on an upper surface of the cross beam to slidingly contact respective rubbed plates provided on a lower surface of a member attached to the carbody, in a plan view, each of the rubbing plates being arranged within a region where the cross beam and the plate spring intersect with each other and being arranged on a center line of the plate spring, the center line extending in the car longitudinal direction, in the side view, each of the rubbing plates being arranged on a center line extending through a center of the pressing member in a vertical direction, in the plan view, the cross beam projecting outward in the car width direction from the plate springs located under the cross beam, when viewed from the car longitudinal direction, the rubbing plate being provided on the upper surface of the cross beam so as to be located on the center line extending through the center of the pressing member in the vertical direction.

5. A bogie supporting a carbody of a railcar, the bogie comprising:

a bogie frame including a cross beam and side members and being rotatable relative to the carbody in a yawing direction, the cross beam extending in a car width direction, the side members supporting both respective car width direction end portions of the cross beam and extending in a car longitudinal direction;

axles extending in the car width direction;

bearings provided at both respective car width direction sides of each of the axles and rotatably supporting the axles;

axle boxes accommodating the respective bearings and supporting the side members from below;

rubbing plates provided on an upper surface of the bogie frame to slidingly contact respective rubbed plates provided on a lower surface of a member attached to the carbody; and a bolster supporting the carbody via air springs and supported by the bogie frame so as to be rotatable relative to the bogie frame in the yawing direction, in a plan view, each of the rubbing plates being arranged within a region where the cross beam and the side member intersect with each other and being arranged on a center line of the side member, the center line extending in the car longitudinal direction, the rubbed plate being attached to the lower surface of the bolster.

6. The bogie according to claim 5, wherein the side members are plate springs which support the respective car width direction end portions of the cross beam from below.

7. The bogie according to claim 5, wherein the rubbing plates are parts of rubbing plate units provided on respective upper surfaces of the cross beam;

the rubbing plate is made of resin; and each of the rubbing plate units includes a receiving member fixed to the upper surface of the cross beam, and the rubbing plate accommodated in a concave portion formed on an upper surface of the receiving member and projecting upward from the receiving member.

8. The bogie according to claim 7, wherein the side members are plate springs which support the respective car width direction end portions of the cross beam from below.

* * * * *